United States Patent [19]

Ross et al.

[11] 4,187,794

[45] Feb. 12, 1980

[54] SEWING MACHINE WORK FEEDING MECHANISM

[75] Inventors: Roger J. Ross, Mont St-Gregoire, Canada; Edward J. Tullman, Union, N.J.

[73] Assignee: The Singer Company, New York, N.Y.

[21] Appl. No.: 40,021

[22] Filed: May 18, 1979

[51] Int. Cl.[2] ..... D05B 27/00

[52] U.S. Cl. ..... 112/308; 112/158 E; 112/121.11

[58] Field of Search ..... 112/308, 309, 303, 158 E, 112/157, 121.11, 121.12

[56] References Cited

U.S. PATENT DOCUMENTS

| | | | |
|---|---|---|---|
| 2,311,222 | 2/1943 | Galkin | 112/308 |
| 2,731,929 | 1/1956 | Ayres | 112/308 |
| 3,096,737 | 7/1963 | Bono | 112/308 |

FOREIGN PATENT DOCUMENTS

| | | | |
|---|---|---|---|
| 244476 | 10/1910 | Fed. Rep. of Germany | 112/308 |
| 1071460 | 1/1955 | Fed. Rep. of Germany | 112/308 |

*Primary Examiner*—H. Hampton Hunter

*Attorney, Agent, or Firm*—Donald P. Gillette; Robert E. Smith; Edward L. Bell

[57] ABSTRACT

A work feeding mechanism for sewing machines including a feed dog with two pair of mutually orthogonal serrated teeth to drive a fabric past a stitch forming area in directions defined by mutually orthogonal axes. The feed dog is pivotally fastened to one extremity of a feed bar whose opposite extremity is suspended by gimbals from a slidable member carried in the bed. Means are disclosed to selectively impart oscillations of a varying amplitude and direction to the slidable member in timed synchronization to the motion imparted to the feed dog, to drive the feed dog in lateral and longitudinal directions of fabric feeding motion which extend along the length of the sewing machine bed and normal to the length of the bed. Fabric feeding information for the work feeding mechanism may be stored in an electronic memory to permit the production of ornamental stitch patterns.

7 Claims, 10 Drawing Figures

ENCODED DATA FOR NORMAL ZIG-ZAG

| STITCH NO. | PULSE LOW TO HIGH | | PULSE HIGH TO LOW | | | |
|---|---|---|---|---|---|---|
| | BIGHT | | LONG. FEED | | LAT. FEED | |
| | CODE | NEEDLE POS. | CODE | WORK FEED | CODE | WORK FEED |
| 1 | 00011 | .120 | 01011 | .060 | 10010 | 0 |
| 2 | 11011 | -.120 | 01011 | .060 | 10010 | 0 |

ENCODED DATA FOR WIDE ZIG-ZAG

| STITCH NO. | PULSE LOW TO HIGH | | PULSE HIGH TO LOW | | | |
|---|---|---|---|---|---|---|
| | BIGHT | | LONG. FEED | | LAT. FEED | |
| | CODE | NEEDLE POS. | CODE | WORK FEED | CODE | WORK FEED |
| 1 | 00011 | .120 | 01011 | .060 | 11011 | -.080 |
| 2 | 11011 | -.120 | 01011 | .060 | 01001 | +.080 |

ENCODED DATA FOR ENLARGED LATERAL GREEK KEY

| STITCH NO. | PULSE LOW TO HIGH | | PULSE HIGH TO LOW | | | |
|---|---|---|---|---|---|---|
| | BIGHT | | LONG. FEED | | LAT. FEED | |
| | CODE | NEEDLE POS. | CODE | WORK FEED | CODE | WORK FEED |
| 1 | 01111 | 0 | 01001 | .080 | 10010 | 0 |
| 2 | 01111 | 0 | 01001 | .080 | 10010 | 0 |
| 3 | 01111 | 0 | 01001 | .080 | 10010 | 0 |
| 4 | 01111 | 0 | 01001 | .080 | 10010 | 0 |
| 5 | 01111 | 0 | 01001 | .080 | 10010 | 0 |
| 6 | 01111 | 0 | 01001 | .080 | 10010 | 0 |
| 7 | 01111 | 0 | 10010 | 0 | 11011 | -.080 |
| 8 | 01111 | 0 | 10010 | 0 | 11011 | -.080 |
| 9 | 01111 | 0 | 10010 | 0 | 11011 | -.080 |
| 10 | 01111 | 0 | 10010 | 0 | 11011 | -.080 |
| 11 | 01111 | 0 | 10010 | 0 | 11011 | -.080 |
| 12 | 01111 | 0 | 10010 | 0 | 11011 | -.080 |
| 13 | 01111 | 0 | 11011 | -.080 | 10010 | 0 |
| 14 | 01111 | 0 | 11011 | -.080 | 10010 | 0 |
| 15 | 01111 | 0 | 11011 | -.080 | 10010 | 0 |
| 16 | 01111 | 0 | 10010 | 0 | 01001 | +.080 |
| 17 | 01111 | 0 | 10010 | 0 | 01001 | +.080 |
| 18 | 01111 | 0 | 10010 | 0 | 01001 | +.080 |
| 19 | 01111 | 0 | 11011 | -.080 | 10010 | 0 |
| 20 | 01111 | 0 | 11011 | -.080 | 10010 | 0 |
| 21 | 01111 | 0 | 11011 | -.080 | 10010 | 0 |
| 22 | 01111 | 0 | 10010 | 0 | 11011 | -.080 |
| 23 | 01111 | 0 | 10010 | 0 | 11011 | -.080 |
| 24 | 01111 | 0 | 10010 | 0 | 11011 | -.080 |
| 25 | 01111 | 0 | 10010 | 0 | 11011 | -.080 |
| 26 | 01111 | 0 | 10010 | 0 | 11011 | -.080 |
| 27 | 01111 | 0 | 10010 | 0 | 11011 | -.080 |

SEWING MACHINE WORK FEEDING MECHANISM

DESCRIPTION

BACKGROUND OF THE INVENTION

1. Field of the Invention

This invention relates to sewing machines in general, and more particularly to a work feeding mechanism which permits a fabric or garment to be fed past the stitch forming area in directions defined by two mutually orthogonal axes.

2. Description of the Prior Art

Sewing machines having mechanical elements for effecting fabric feeding to the right or left sides of a normal line of feeding are known in the prior art. Such machines frequently employ cams which impart fabric feeding motion to the feed dog through mechanical arrangements which are difficult to manipulate to achieve a variety of intricate stitch patterns. Sewing machines are also known in the prior art which employ linear actuators to permit the production of intricate ornamental stitches from patterns which are stored in electronic memories. See for example U.S. Pat. No. 3,855,956 which issued to Wurst on Dec. 24, 1974 which is owned by the assignee of this invention and the teachings of which are incorporated herein by reference. While such machines have the capability of producing a wide variety of ornamental stitches, they are not able to produce stitches in which the pattern width, or bight exceeds the maximum relative displacement between the sewing needle and the looptaker at which a stitch may be formed.

Sewing machines are also known in which a periodic swinging of the needle bar while the needle is penetrating the material being sewn produces lateral fabric feeding motion to the right or left of the normal line of fabric feeding. With such work feeding mechanisms however, the ability of the sewing machine to produce zig zag stitch patterns while feeding to the right or left is curtailed.

The prior art does not disclose a sewing machine work feeding mechanism which intermittently engages and transports the work in response to electronic signals stored in an electronic memory for transporting the fabric being sewn past the needle in any direction. The implementation of such a mechanism provides a sewing machine having the capability of stitching straight or zig zag patterns over large areas not necessarily confined to the width of permissable zig zag stitching.

SUMMARY OF THE INVENTION

It is an object of this invention to produce a sewing machine work feeding mechanism of the type which imtermittently engages the work fabric which is compatible with electronically controlled sewing machines having stitch forming instrumentalities which are responsive to stitch pattern information stored in electronic memories.

It is also an object of this invention to produce a work feeding mechanism which will not interfere with straight line stitching.

Still another object of this invention is to produce a work feeding mechanism in which lateral fabric feeding to the right or left of a normal line of fabric feeding is produced by motion of the feed dog.

Another object of this invention is to produce a work feeding mechanism in which the quantity of lateral fabric feeding to the right or left of a normal line of fabric feeding may be dictated by electronic means.

The above objects and other advantages are achieved by suspending the pivoted extremity of a feed bar from a slide plate which is slidably fastened to the sewing machine bed. The extremity of the feed bar opposite the pivoted extremity supports a feed dog having four sets of mutually orthogonal work-engaging teeth. The pivoted extremity of the feed bar is suspended relative to a set of mutually orthogonal axes which permit the feed bar to be driven by a feed lift cam and a feed advance eccentric to impart to the feed dog components of normal fabric feeding motion above and below the throat plate and feed advance and return motion to move fabric toward a stitch forming area on the throat plate. Lateral fabric feeding motion to the right or left of the line of normal material feeding is supplied by a drum cam having a track on its face which is driven by the feed drive shaft in timed relation to the rotation of the feed lift cam and feed advance eccentric. A slide block having a cam follower pin at one extremity thereof is pivotally suspended at its center by a pivot pin which is fastened to the sewing machine bed so that the follower pin contacts the track contained on the face of the drum cam. Rotation of the cam imparts arcuate pivotal motion to the slide block about the pivot pin. A follower link has one extremity pivotally fastened to the slide plate from which the feed bar is suspended. The other extremity of the link contains a slide follower which engages, and may be selectively positioned along, a track contained in the slide block. A linear actuator which is responsive to electronic signals is fastened to the follower link to permit the position of the slide follower to be varied relative to the pivot point of the slide block. The lateral feeding direction (either to the right or left of the normal line of material feeding) and magnitude are determined by the position and distance of the slide follower relative to the pivot pin which fastens the slide block to the bed, and may be adjusted independent of the feed lift and material advance adjustments imparted to the feed dog by control signals applied to the linear actuator.

BRIEF DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction, and advantages of it when read in conjunction with the accompanying drawings in which.

DESCRIPTION OF THE PREFERRED EMBODIMENT

Figure 1:
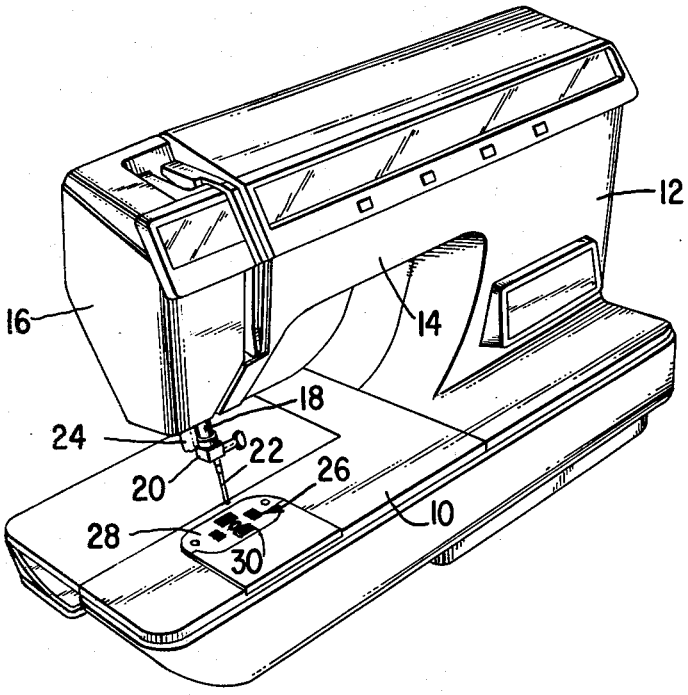
FIG. 1 is a perspective view of a sewing machine having a work feeding mechanism constructed in accordance with the teachings of the present invention applied thereto.
Figure 2:
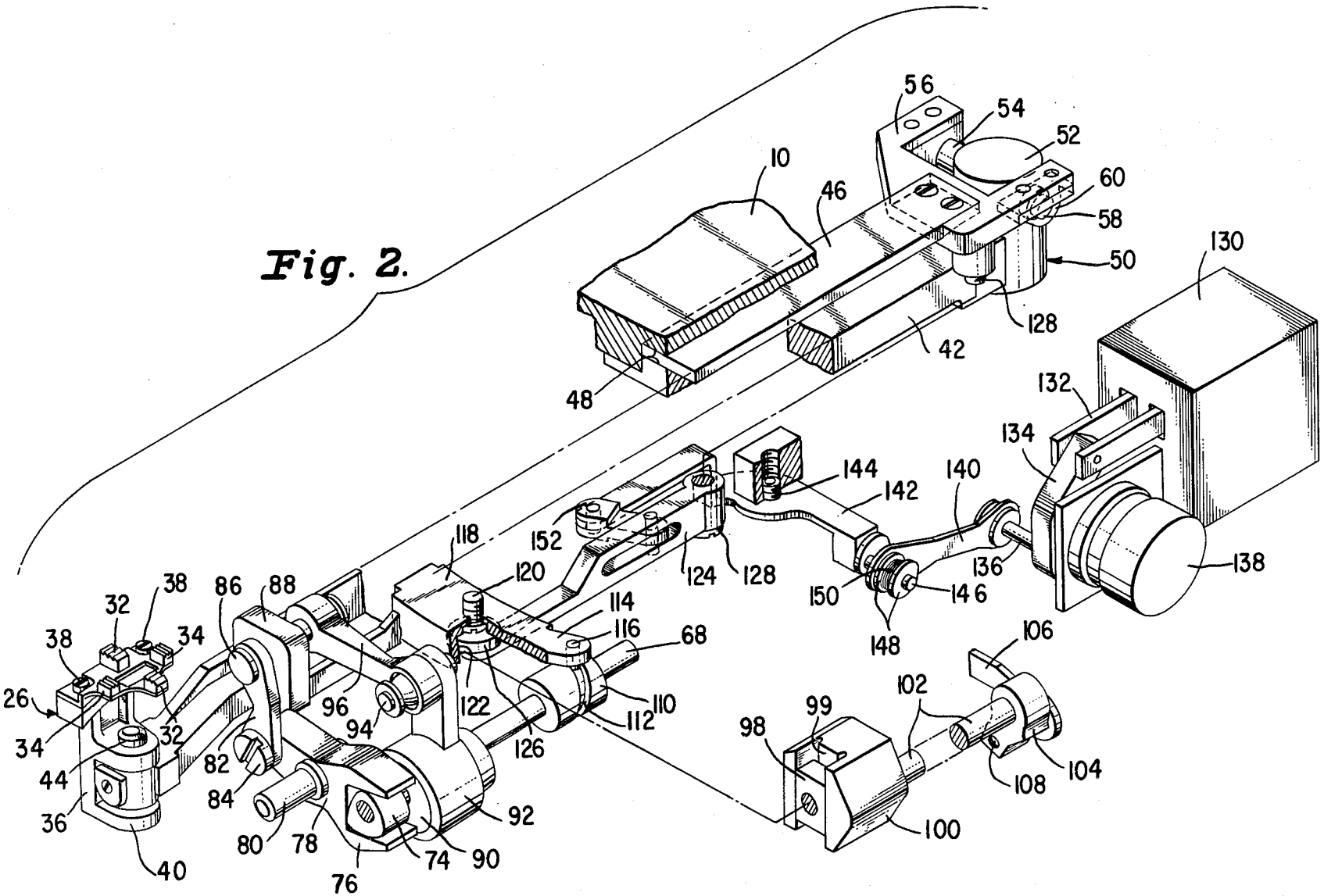
FIG. 2 is a disassembled perspective view of the work feeding mechanism.

Referring to the drawings, FIG. 1 shows a sewing maching having a work supporting bed 10 with an axis extending along its length. A standard 12 rises from the bed 10 and supports an arm 14 which overhangs the bed 10 and terminates in a sewing head 16. A needle bar 18 is reciprocatorily journalled in the sewing head 16 and is driven toward and away from a stitch forming area contained on the surface of the bed 10. The needle bar has a clamp means 20 which fastens a needle 22 thereto. The needle 22 carries a needle thread (not shown) which is concatenated with a lower (bobbin) thread to form a lockstitch in a manner that is well known in the art of sewing. Also carried in the sewing head 16 is a presser bar 24 which may be lowered against the fabric being sewn to contain the fabric against the thrust of a feed dog, which is shown generally at 26, and which moves the fabric toward and away from a needle-penetrating, stitch-forming area formed on the surface of the bed 10. A throat plate 28, which contains a set of mutually orthogonal feed dog accommodating slots 30, is removably carried flush to the surface of the bed 10 and acts to support the fabric against the downward thrust of the needle 22. The feed dog 26 has a first pair of serrated teeth 32 positioned to move fabric in a normal longitudinal line of fabric feeding which is directed in a line which runs substantially perpendicular to the length of the sewing machine bed 10 and a second pair of serrated teeth 34 positioned to move fabric laterally along the length of the bed 10. FIG. 2 best illustrates that the feed dog 26 is preferably fastened to a feed dog bracket 36 by a set of fasteners such as the screws 38. The feed dog bracket 36 has a pair of bifurcated ears 40 which accommodate one extremity of an elongated feed bar which is shown generally at 42. Preferably the feed dog bracket 36 is pivotally fastened to the feed bar 42 with a cylindrical pivot pin 44 which allows the bracket 36 to rock about the feed bar 42.

It will be appreciated by those skilled in the art of sewing machine design that it is necessary to move a fabric being sewn past the stitch forming area on the sewing machine bed so that the reciprocating needle may penetrate it to produce stitches at periodic intervals along the fabric. One preferred example of a work feeding mechanism which may be employed to produce fabric feeding movement in a normal line of feed, i.e., a straight line transversely across the sewing machine bed is more fully disclosed in U.S. Pat. No. 3,527,183 which issued on Sept. 8, 1970, to Szostak, the rights to which are owned by the assignee of this invention, and the teachings of which are incorporated herein by reference. As more difficult sewing projects are undertaken, however, a skilled sewer will become increasingly aware of the advantages of being able to move the fabric being sewn laterally to both the left and right side of the normal line of fabric feeding which is defined as a line extending transversely across the bed 10, in a direction which is perpendicular to the length of the bed 10.

FIG. 2 shows that preferably the feed mechanism comprises the elongated feed bar 42 which is pivotally attached to a slidable member 46 carried in a cavity having a pair of spaced parallel walls 48 formed in the sewing machine bed 10 and which are parallel to the axis running along the length of the bed. The member 46 and walls 48 are oriented to permit the feed bar 42 to be oscillated along the length of the bed 10, in a line which is perpendicular to the normal line of fabric feeding. Preferably the extremity of the feed bar 42 opposite the feed dog 26 is suspended from the slidable member 46 by a pivot pin 50 having an enlarged head 52 through which passes a cylindrical trunnion pin 54 which is retained to a U-shaped section 56 of the member 46 by a set of pintles 58 which are held fast by a pair of saddles 60. The set of pintles 58 engage a pair of conical seats (not shown) formed at the extremities of the trunnion pin 54. It is to be understood that the combination of the pivot pin 50 and the trunnion pin 54 form gimbals which permit the feed bar 42 to be oscillated in mutually perpendicular directions, one direction moving the feed dog 26 toward and away from the throat plate 28 to raise the teeth of the feed dog 26 above and below the throat plate 28, and a second direction moving the feed dog 26 transversely across the surface of the bed 10, thereby defining the normal or longitudinal line of fabric feeding such as that described in the aforementioned patent to Szostak.

As is more particularly described in the aforementioned Szostak patent, the feed bar 42 is oscillated above and below the throat plate 28 and transverse to the length of the bed 10 by an adjustable drive mechanism which is operable in timed relation with the sewing machine by a motor (not shown) driving a toothed belt 62, which transmits rotary motion to a bed-mounted drive shaft 64 through a gear 66. Preferably a feed drive shaft, a portion of which is shown at 68, is drivingly connected to the bed drive shaft 64 by a set of gears 70 and 72. It will be appreciated that since the shaft 68 is connected through the gears 66, 70 and 72, and the toothed belt 62, the shaft 68 will accurately partake of any speed changes imparted to the needle 22 by the motor.

The shaft 68 has fastened thereto a constant breadth feed lift cam 74 which is embraced by a bifurcated extremity 76 of a lever 78 which is fulcrummed on a stud 80 fastened to the bed 10. A link 82 is pivotally fastened to the lever 78 at one extremity thereof by a shouldered fastener 84. The other extremity of the link 82 is pivotally fastened by a pin 86 to a block 88 which is rigidly attached to the feed bar 42.

A feed advance eccentric 90 is also fastened to the shaft 68 and is embraced by a pitman 92 which is connected by a pivot pin 94 to a link 96 whose opposite extremity loosely embraces the pin 86 carried by the nblock 88.

Figure 3:
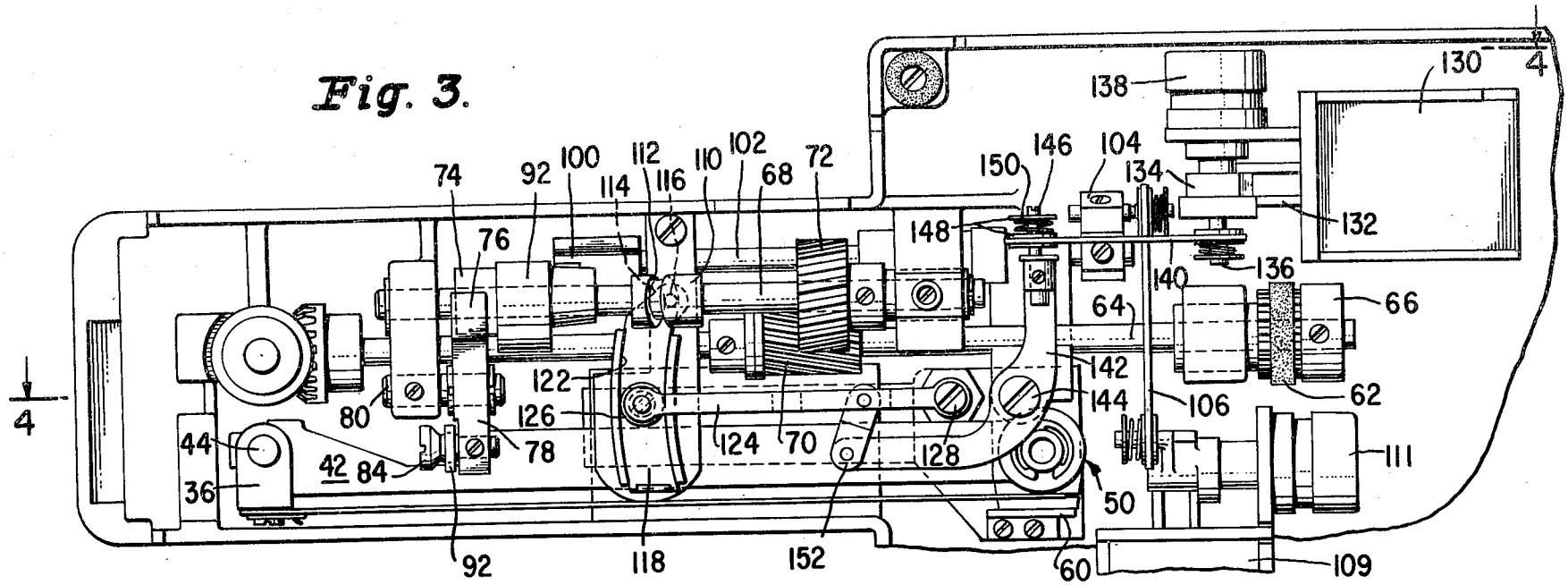
FIG. 3 is a cutaway top plan view of the bed of a sewing machine showing the work feeding mechanism.
Figure 4:
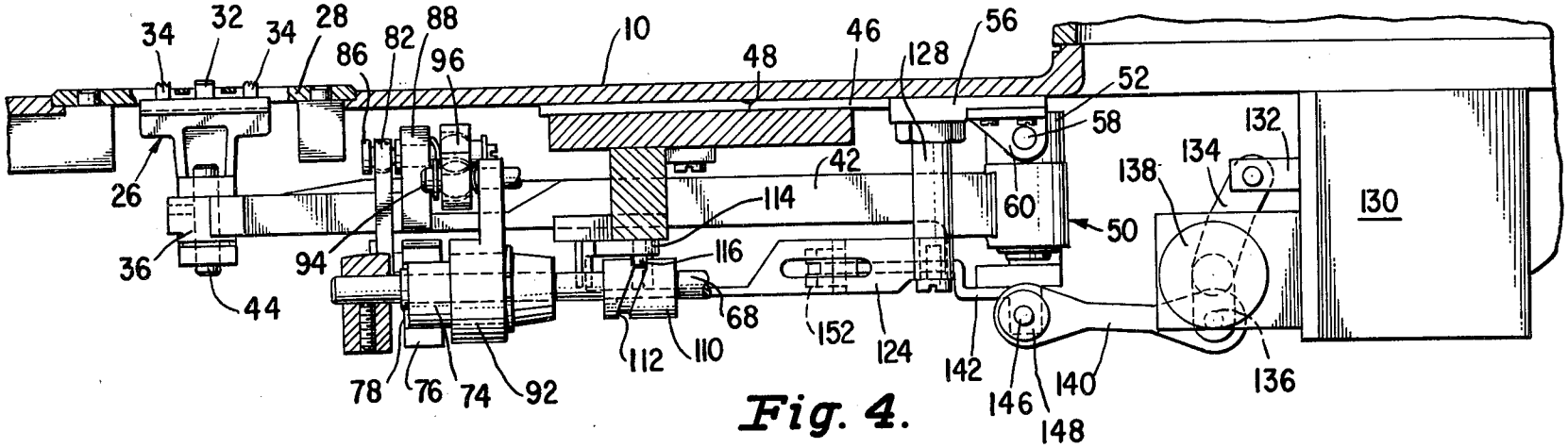
FIG. 4 is a front view partially in section taken along line 4—4 of FIG. 3.

The link 96 and the pitman 92 together define a toggle at the pivotal connection therebetween provided by the pivot pin 94. The motion of the toggle in response to rotation of the feed advance eccentric 90 is controlled by a slide block 98 to which the pivot pin 94 is fastened. The block 98 is constrained in a guide slot 99 formed in a block 100 which is made fast to a feed control rock shaft 102. A crank 104 is fastened to the rock shaft 102 and has a pivotal link 106 attached thereto with a pivot pin 108. Preferably the link 106 is fastened to a linear actuator 109 (shown in FIG. 3) having a position sensor shown preferably as the potentiometer 111. The actuator 109 may be excited electrically to vary the angular displacement of the block 100. As is more completely described in the aforementioned patent to Szostak, the motion imparted to the feed dog 26 by the feed bar 42 in response to the constant breadth cam 74 and the feed advance eccentric 90 occurs in arcuate paths about the mutually perpendicular axes of the gimbals defined by the pivot pin 50 and the trunion pin 54, the angular displacement of the block 100 defining the length of longitudinal feed advance in a direction transverse to the length of the sewing machine bed 10 imparted to the fabric by the feed dog 26.

Oscillatory fabric feeding motion in lateral directions to the right or left of the normal line of material feed is imparted to the feed bar 42 by a drum cam 110 which is rotatably fastened to the feed drive shaft 68. The cam 110 contains a track 112 whose path imparts a periodic oscillatory motion in response to rotation of the cam 10 to a follower 114 having a pin 116 which engages the track. The follower comprises one extremity of an elongated slide block 118 which is pivotally suspended at its center from the bed 10 by a pivot pin 120. The slide block 118 contains a track 122. A follower link 124, having at one extremity thereof a slide follower 126 which is received in the slide block track 122, is rigidly suspended at its other extremity from the slide plate 46 by a pivot pin 128, which permits the follower link 124 to arcuately rotate thereabout in a horizontal plane which is parallel to the plane of the slide plate 46.

The position of the slide follower 126 within the track 122 is controlled by a linear actuator 130 having an armature 132. Preferably the armature 132 drives one extremity of a pivotal lever 134 which pivotally rocks about a shaft 136. Fastened to one extremity of the shaft 136 is a potentiometer 138 whose electrical characteristics are varied in proportion to the position of the armature 132 and the detailed operation of which need not be understood for a full and complete understanding of the present invention. Fastened to the extremity of the pivotal lever 138 opposite that having the armature 132 fastened thereto is a link 140. The link 140 transmits arcuate pivotal motion imparted to the pivotal lever 134 by the actuator 130 to a bell crank 142 which is pivotally fastened to the sewing machine bed 10 by a pin 144. The link 140 is fastened to the crank 142 with a pin 146 which loosely receives the link 140 and which is resistively held thereto with a pair of washers 148 and a coil spring 150 retained therebetween which insures that linear motion imparted to the link 140 is translated into arcuate pivotal motion of the crank 142. The extremity of the crank 142 opposite the link 140 is fastened to the follower link 124 with an articulated link 152 having a first extremity pivotally fastened to the follower link 124 and a second extremity pivotally fastened to the bell crank 142. The link 152 allows the follower link 124 to be arcuately adjusted relative to the slide block 118 to vary the magnitude and direction of motion imparted to the feed bar 42 by the drum cam 110 through the follower 124 and the pivot pin 128.

It may be seen from FIG. 2 that the position of the slide follower 126 within the slide block track 122 may be controlled by applying electrical signals to the linear actuator 130 which causes the armature 132 to move, thereby causing the crank 142 to pivotally rotate the follower link 124 about the pivot pin 128.

Rotation of the drum cam 110 by the feed drive shaft 68 causes the slide block 118 to periodically pivot about the pivot pin 120 in response to the follower pin 116 following the motion of the track 112. Lateral fabric feeding to the right or left of the normal line of material feed may be controlled by moving the follower link 124 so that the slide follower 126 is either located to the right side or left side of the pivot pin 120 which fastens the slide block 118 to the bed 10. Since no motion relative to the pivot point is imparted to the slide blick 118 by the drum cam 110 and follower 114 at the point at which the pivot pin 120 is fastened to the slide block 118, lateral feeding motion to the right or left of the line of material feed will not be imparted to the feed bar 42 when the slide follower 126 is moved to maintain a position in direct alignment with the pivot pin 120. The amount of feeding motion imparted to the right or left of the line of material feed may be varied by increasing the distance between the slide follower 126 and the pivot pin 120.

It may also be seen that since the feed lift cam 74 and the drum cam 110 are commonly driven from the feed drive shaft 68, the lateral motion of the feed dog 26 to the right or left of the normal line of material feed may be adjusted to coincide with the rising motion of the feed dog 26 above the throat plate 28 by radially adjusting the displacement of the drum cam 110 relative to the feed lift cam 74.

It will be appreciated from a review of FIG. 2 that the amount of fabric feeding along the longitudinal line of material feed may be adjusted independent of the amount of lateral feeding to the right or left of the line of material feed by adjusting the angular displacement of the slide block 100, which has no effect on the motion imparted to the slide block 118 by the cam 110. Since feeding along the longitudinal line of material feed and lateral feeding to the right or left of the longitudinal line of feed may be independently adjusted in both magnitude and direction, it is possible to sew intricate patterns with the only limitation on pattern width being dictated by the ability to contain fabric between the needle bar 18 and the standard 12.

Figure 5:
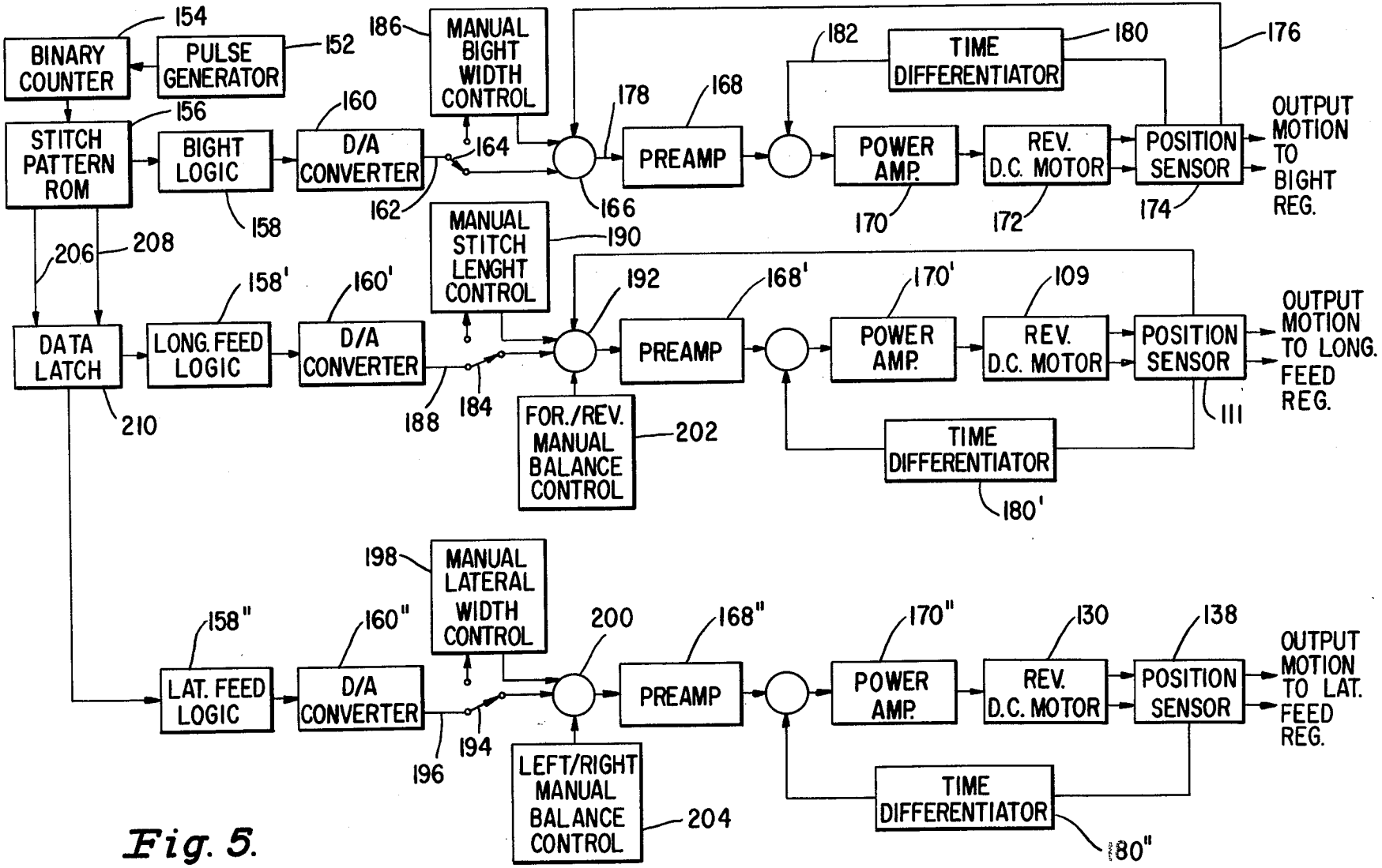
FIG. 5 is a block diagram of an electronic sewing machine having the teachings of this invention applied thereto.
Figure 7A:
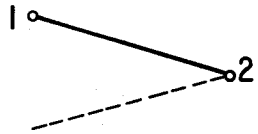
FIG. 7 shows a laterally enlarged zig zag stitch obtained by the use of this invention and also showing a table of the binary encoded data used to produce the stitch.
Figure 7:
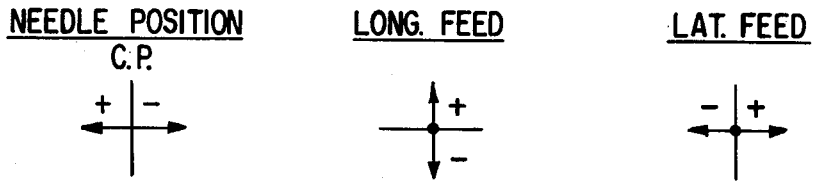

FIG. 5 best illustrates a preferred embodiment of an electronic sewing machine to which the teachings of this invention may be advantageously applied so that the needle bar 18 and the needle 22 carried thereby may be shifted to a selected lateral position, and the feed dog 26 may be moved in a selected direction at a selected rate for feeding the work material in a longitudinal or a lateral direction. Further specifics on the location and interrelation of the components shown in FIG. 5 to each other and to the sewing machine instrumentalities may be had by reference to the U.S. Pat. No. 3,984,745 which issued on Oct. 5, 1976 to Minalga, and which is assigned to the same assignee of the present invention, which patent is hereby incorporated by reference and made a part of this application. Thus, a pulse generator 152 which may be driven by any mechanically actuated part of the sewing machine is arranged to provide a high pulse when the needle 22 leaves a work material being sewn and a low pulse when the needle 22 reenters the material. The pulse shifts from low to high generated by the pulse generator 152 are counted in a binary counter 154 in order to provide an address input for an electronic memory means shown as a stitch pattern ROM 156 which increases for each stitch to provide a successive pattern of stitches in the formation of ornamental patterns. The address from the binary counter 154 to the stitch pattern ROM 156 causes the ROM to supply a digital output therefrom with information related to the positional coordinates for each stitch of a selected pattern. The bight information from the stitch pattern ROM 156 passes to the bight logic 158 processing for example into pulse width modulated form and for retention for the duration of the stitch. Thereafter, the pulse width modulated signal will pass from the bight logic 158 to a digital-to-analog converter 160 for conversion to a form suitable for use by the linear actuators. The converter 160 outputs to a line 162 a DC analog voltage representing the required bight position input. This line connects, in the automatic mode position of a switch 164 to the summing point 166 of a low level preamplifier 168 forming the first stage of a servo amplifier system. The preamplifier 168 drives a power amplifier 170 which supplies direct current of reversible polarity to a electromechanical actuator 172, which in the broadest sense comprises a reversible motor, to position the actuator in accordance with the input and voltage on the line 162. A feedback position sensor 174 mechanically connected to the reversible motor 172 provides a feedback positional signal on line 176 indicative of the existing output position. The input analog voltage and the feedback are algebraically summed at the summing point 166 to supply an error signal on line 178. The feedback signal from the position sensor 174 is also differentiated with respect to time in a differentiator 180 and the resulting rate signal is presented on line 182 to the summing point of the power amplifier 170 to modify the positional signal at that point. The explanation of the bight actuating circuitry completed thus far will also serve to explain the lateral and the longitudinal feed actuating circuitry operation. Corresponding blocks in each system which are substantially similar carry the same reference number except that the numbers associated with the longitudinal feed system are single primed and those associated with the lateral feed system are double primed. In the explanation completed thus far the only substantial difference would be that the switch 184 for the longitudinal feed shown in the automatic position and the switch 194 for the lateral feed, which is also shown in the automatic positions are given different numbers to signify that their operations are not dependent on operation of the bight switch 164. Since the feed actuating circuit for both lateral and longitudinal feeding is substantially similar to the bight actuating circuit thus far described, the explanation provided hereafter of the feed actuating circuit will be directed toward the substantial differences between the bight and feed actuating circuits.

Referring once again to FIG. 5, the bight switch 164 is shown in the position for automatic operation according to stitch pattern information stored in the ROM 156. If the bight switch 164 were thrown to the manual position, the signal on line 162 would pass to the manual bight width control 186 before passing to the summing point 166. The manual bight width control 186 may be varied by the sewing machine operator. The purpose of this control is to permit the signal from the stitch pattern ROM 156 to be altered to suit the needs or desires of a sewing machine operator. Further particulars on how this may be accomplished may be had by reference to U.S. Pat. No. 4,016,821, issued on Apr. 12, 1977 to Minalga which is assigned to the same assignee as the instant invention and is hereby incorporated by reference herein. By way of explanation it is sufficient to note that the manual bight width control 186 is implemented by an operational amplifier in which the feedback resistance may be modified to vary the gain thereof, thereby to vary the analog signal on the line 162 prior to connection to the summing point 166. In the longitudinal feed actuating circuit, positioning of the longitudinal feed switch 184 to the manual position will connect the longitudinal feed analog signal on line 188 to a manual switch length control 190 which may also be implemented by an operational amplifier having a variable feedback resistance to vary the gain thereof. Similarly, positioning of the lateral feed switch 194 to the manual position will connect the feed analog signal on line 196 to a manual lateral width control 198 to thereby vary the analog signal prior to connection to the summing point 200.

The actual amount of feed imparted to the work itself by the feed dog 26 depends on many factors including the nature and thickness of the work, the pressure applied by the presser foot and the rate of feed. To compensate for such discrepancy, it is necessary to introduce at summing points 192 and 200 balance control voltages derived from the potentiometers 202 and 204 connected as voltage dividers to the double ended reference voltage output of a power supply. Further specifics on the manual balance controls 202 and 204 shown in FIG. 2 and how they affect the motion imparted by the feed dog 26 may be had by reference to the above noted Minalga patent.

As referred to above, the pulse generator 152 passes from a low state to a high state when the sewing needle 22, moving in an upstroke, comes out of contact with the work material. The low to high pulse from the pulse generator 152 advances the binary counter 154 one step and signals release of pattern stitch information from the stitch pattern ROM 156, thereby permitting specific bight information to pass along line 162 to the bight logic 158. Simultaneously, specific feed information passes along lines 206 and 208 to a data latch 210 where this information is retained until the proper time for release. In normal stitch patterning, when the sewing needle 22 is removed from a work material the needle bar 18 may be positioned for a subsequent stitch and the work material may be operated on by the feed dog 26 to move the fabric in a longitudinal and a lateral direction. Longitudinal and lateral feed motion takes place after the sewing needle 22 is withdrawn from the fabric and prior to reentry of the fabric by the sewing needle. When the sewing needle 22 reenters the work material, the feed dog 26 becomes ineffective to feed the work material and usually partakes of an idle return to a starting position. During the interval while the sewing needle 22 is in the work material, the block 100 and the follower 126 of the work feed system of the sewing machine may be manipulated to prepare for a new feed rate and direction for the succeeding stitch. Thus, the feed information must be retained in the data latch 210 until that time when the sewing needle 22 reenters the work material. As set forth above, the pulse generator 152 passes from a high state to a low state when the sewing needle 22 reenters a work material. This high to low pulse step of the pulse generator 152 signals the feed data latch 210 to release the feed information retained therein to the longitudinal feed logic 158′ and the lateral feed logic 158″ for processing and retention by the digital to analog converters 160′ and 160″, and amplification and operation of the reversible DC motors 109 and 130 in order to achieve a new feed rate and/or direction.

Thus far there has been described an electronically controlled sewing machine having a stitch pattern capability retained in a static memory implemented by the stitch pattern ROM 156. A sewing machine so equipped may perform a multiplicity of ornamental patterns within the confines of the lateral excursion capability of the needle and the patterns may be of unlimited length according to the variable rate and direction information retained in the stitch pattern ROM 156 along with the needle position information.

Figure 6A:
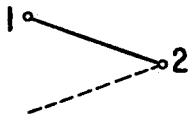
FIG. 6 shows a normal zig zag stitch utilizing the maximum width of pattern attainable without utilization of this invention and a table of the binary encoded data used to produce the stitch.
Figure 6:
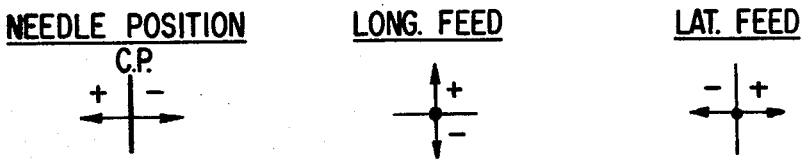

Referring now to FIG. 6, there is shown in FIG. *6a* the normal maximum bight zig zag stitch which may be produced by using needle bar bight positioning information and without the need for lateral feeding information. In FIG. *7a*, there is shown the enlarged bight zig zag stitch attainable by the sewing machine of FIG. 1 using the teachings incorporated herein. The table shown in FIG. 6 indicates the binary code words retained in the stitch pattern ROM 156 and released sequentially therefrom in order to acheive the pattern indicated in FIG. *6a*. Adjacent each code word is the needle position dimension from center needle position, and the longitudinal and lateral feed increment dimensions represented by the binary code words. Center position (CP) would therefore be zero, and full left needle position would be +0.120, and right needle position would be −0.120. A positive longitudinal feed increment would indicate forward feed and a negative longitudinal feed increment would indicate reverse feed. Similarly, a positive lateral feed increment would indicate feed to the right and a negative lateral feed increment would indicate feed to the left. When the sewing needle 22 is removed from a work material, the pulse from the pulse generator 152 goes from low to high releasing the bight, lateral and longitudinal feed code words from the stitch pattern ROM 156. The sewing needle 22 is urged downwardly by the sewing machine actuating mechanism, and when it extends into the work material, the pulse from the pulse generator 152 goes from a high to a low state. The work feed information is released from the data latch 210 to the longitudinal feed logic 158' and the lateral feed logic 158", causing the feed actuating circuits to implement repositioning of the block 100 and the follower 126 of the work feed system in the sewing machine in preparation for a work feeding step when the sewing needle 22 is next removed from the work material. On stitch number two, the bight information released when the needle is out of the fabric causes motion of the sewing needle 22 from the extreme left position to the extreme right position. Simultaneously therewith, the block 100 and the follower 126 are again moved to new positions in preparation for the succeeding work feeding motion when the sewing needle is removed from the work material.

By an inspection of FIG. *7a*, it is apparent that the sewing machine herein described has the capability for effecting a zig zag stitch with a width exceeding the maximum lateral excursion of the needle between successive stitches. The density of the zig zag stitch so achieved is strictly a function of the programmed work feed increment. Although the zig zag stitch of FIG. *7a*, and the encoded data therefore, is for a zig zag stitch having approximately twice the bight of that shown in FIG. *6a*, it will be apparent that using the teachings herein disclosed zig zag patterns of extremely large width are made possible.

The zig zag stitch shown in FIG. *7a* serves to indicate the enlarged feed capabilities attainable by using the combination of lateral feeding and stitch bight to increase the lateral distance between successive stitch penetrations. By the same method used to obtain the enlarged zig zag stitch of FIG. *7a*, it will be appreciated that it is entirely possible to obtain an enalrged Greek key extending longitudinally. However, in order to demonstrate the flexibility of the X-Y patterning capability as provided by this invention, the encoded data has been supplied for obtaining an enlarged Greek key extending in the lateral direction.

Figure 8:
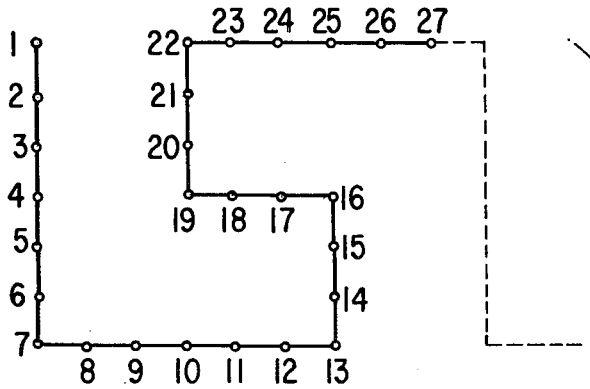
FIG. 8 shows a laterally enlarged Greek Key stitch pattern obtained by the use of this invention and a table of the stitch pattern data used to produce the stitch.

From an inspection of the encoded data of FIG. 8 for the enlarged lateral Greek key, it will be noted that in stitches 1 through 6 the needle 22 enters the fabric and the feed dog 26 moves the fabric through successive longitudinal increments of 0.080. In stitch seven the material is shifted laterally to the left an increment of 0.080. Movement of the material to the left continues in increments of 0.080 until stitch 13 is reached, after which the material is moved in a longitudinal direction which is the reverse of the direction of movement of stitches 1 through 6, until stitch 16, at which time the material is moved laterally to the right while stitches 16 through 18 are formed. Stitches 19 through 21 are produced with the fabric being fed in a longitudinal line in the same direction as stitches 13 through 15. The stitches 22 through 27 are produced with the feed dog 26 laterally moving the fabric to the left a distance of 0.08 inch for each succesive stitch. After stitch 27, by the use of an encoded word in the stitch pattern ROM 156, the binary counter 154 may be reset to reinitiate stitching at stitch 1.

The encoded data for the enlarged lateral Greek key was prepared to obtain a Greek key approximately twice the size of that obtainable from heretofore known household sewing machines. It will be readily apparent to those skilled in the art that an even larger Greek key may be stitched by a machine as disclosed herein by repeating the groups of identical stitches a suitable number of times. It will be further evident to those skilled in the art that although the Greek key pattern disclosed is essentially rectilinear, an extremely large variety of ornamental patterns may be fashioned which are curvilinear by providing during the same stitch simultaneous stitch bight changes, and work feed increments in the longitudinal and lateral directions. However, in order to avoid necessity for providing voluminous tables of encoded data which may be required for the explanation of such a pattern, this has been avoided.

From the above detailed description of a preferred embodiment of the invention it will be apparent that what has been described is a novel work feeding mechanism for sewing machines having an electronic patterning capability which may find particular utility in affording a sewing machine operator the ability to produce intricate or decorative stitches with a minimum of manual intervention. While the invention has been described in its preferred embodiment, it will be obvious to those skilled in the art that various changes and modification may be made therein without departing from the spirit and scope of the invention as set forth in the appended claims.

We claim:

1. A work feeding mechanism for a sewing machine having a work supporting bed with an axis along its length, a throat plate having a set of mutually orthogonal feed dog accommodating slots defining mutually perpendicular directions of work feeding along the surface of said bed, said directions comprising a longitudinal direction of feeding extending in a direction transverse to the axis along the length of said bed, and a lateral direction of fabric feeding perpendicular to said longitudinal direction, an elongated feed bar carried beneath said bed and extending substantially along the length of said work supporting bed, a feed dog pivotally supported at one extremity of said feed bar and having a set of mutually orthogonal work engaging teeth positioned to be accommodated within said feed dog accommodating slots, gimbal means fastened to said feed bar and supporting the extremity of said feed bar opposite the extremity having said feed dog pivotally fastened thereto to permit said feed dog to be driven in said longitudinal direction transversely across said bed and in a direction above and below said throat plate, slidable means constrained to said bed to slide along a line extending parallel to the axis of said bed, means fastened to said slidable means for suspending said gimbal means from said slidable means, a feed bar drive mechanism operable in timed relation to said sewing machine for imparting oscillations to said feed bar about said gimbal means in mutually perpendicular directions, including said longitudinal direction transversely across said bed to provide work advancing and return movements to said feed dog, and in said direction above and below said throat plate to raise said feed dog to a position above said throat plate during work advancing movement and to drop said feed dog below said throat plate during the return movement thereof, means driven by said feed bar drive mechanism for imparting oscillatory motion to said slidable means along said axis along the length of said bed, and adjustable control means responsive to electrical signals for varying the amplitude and direction of oscillatory motion impated to said slidable means by said oscillatory drive means.

2. The work feeding mechanism as set forth in claim 1 wherein said means for imparting oscillatory motion to said slidable means comprises a drum cam having a track rotatably driven by said drive mechanism, said drum cam rotating in timed synchronization to the oscillations imparted to said feed bar by said feed bar drive mechanism, and a follower link having a first extremity oscillatorily driven by rotation of said cam and a second extremity pivotally fastened to said slidable means to transmit oscillatory motion imparted to said follower link by said cam to said slidable means.

3. The work feeding mechanism as set forth in claim 2 wherein said follower link for transmitting oscillatory motion between said cam and said slidable means may be adjusted independent of said feed bar drive mechanism.

4. The work feeding mechanism as set forth in claim 2 wherein said adjustable control means comprises a slide block pivotally fastened to said bed at a pivot point, said slide block having a track along its length and a follower pin at one extremity thereof for engagement with the track carried by said drum cam, said follower link for transmitting oscillatory motion between said cam and said slidable means pivotally fastened at said second extremity to said slidable means and having a slide follower at said first extremity for engagement with the track carried by said slide block, and an electronically driven position varying means fastened to said follower link for varying the position of said slide follower along said slide block track relative to said pivot point of said slide track, said follower link transmitting periodic oscillatory motion imparted to said slide block by said drum cam to said slidable means.

5. The work feeding mechanism as set forth in claim 4 wherein said electronically driven position varying means comprises a linear actuator.

6. The work feeding mechanism as set forth in claim 1 wherein said slidable means comprises a plate carried on the underside of said work supporting surface, a cavity in said bed having a pair of spaced parallel walls extending parallel to said axis along the length of said bed, said plate being received in said cavity, said walls of said cavity defining a means for constraining motion imparted to said slidable means to a direction along the length of said bed.

7. The work feeding mechanism as set forth in claim 1 further comprising electronic memory means for storing needle position information and information for moving said feed dog in said lateral and said longitudinal directions, and means for operating said electronically driven position varying means in response to information stored in said electronic memory means.

* * * * *